US005140717A

United States Patent [19]

Castagliola

[11] Patent Number: 5,140,717

[45] Date of Patent: Aug. 25, 1992

[54] CLEANING DEVICE

[75] Inventor: Louis J. Castagliola, Brooklyn, N.Y.

[73] Assignee: Uneedit, Inc., Brooklyn, N.Y.

[21] Appl. No.: 746,063

[22] Filed: Aug. 12, 1991

Related U.S. Application Data

[63] Continuation of Ser. No. 502,839, Mar. 30, 1990, abandoned.

[51] Int. Cl.[5] ..... A47L 13/11

[52] U.S. Cl. ..... 15/209.1; 15/245; 15/244.1; 15/210.1; 15/220.1

[58] Field of Search ..... 15/209 R, 210 R, 245, 15/220 R, 244.1, 244.2, 114, 118, 121

[56] References Cited

U.S. PATENT DOCUMENTS

| | | | |
|---|---|---|---|
| 1,500,274 | 7/1924 | Scarling | 15/245 |
| 1,554,242 | 9/1925 | Tanner | 15/245 |
| 2,032,626 | 3/1936 | Moller | 15/245 |
| 2,043,775 | 6/1936 | Rosen | 15/245 |
| 2,088,777 | 8/1937 | Dennis | 15/245 |
| 2,103,198 | 12/1937 | Siemund | 15/245 |
| 2,179,223 | 11/1939 | Siemund | 15/245 |
| 3,029,459 | 4/1962 | Pruitt | 15/235.4 |
| 3,089,173 | 5/1963 | Hunt | 15/245 |
| 3,129,448 | 4/1964 | Mittman | 15/1.5 |
| 3,144,671 | 8/1964 | Gould | 15/1.5 |
| 3,162,880 | 12/1964 | Francis | 15/234 |
| 3,355,755 | 12/1967 | Brooks | 15/1.5 |
| 3,457,579 | 7/1969 | Shea | 15/245 |
| 3,737,938 | 6/1973 | Saltzstein | 15/210 R X |
| 3,827,100 | 8/1974 | Griffin et al. | 15/229 A |
| 4,312,093 | 1/1982 | Raab | 15/220 R |
| 4,398,839 | 8/1983 | Kluck | 15/244.1 X |
| 4,658,461 | 4/1987 | Roe et al. | 15/210 R |
| 4,716,616 | 1/1988 | Poon | 15/245 |
| 4,750,233 | 6/1988 | Swain | 15/244.1 X |
| 4,793,019 | 12/1988 | Stima | 15/244.1 X |
| 4,852,203 | 8/1989 | LaBelle | 15/244.1 X |
| 4,872,237 | 10/1989 | Smith | 15/244.1 X |
| 4,976,000 | 12/1990 | Wiley | 15/210 R X |
| 5,003,659 | 4/1991 | Paepke | 15/244.1 X |

FOREIGN PATENT DOCUMENTS

| | | | |
|---|---|---|---|
| 0052593 | 5/1982 | European Pat. Off. | 15/245 |
| 709511 | 5/1931 | France | 15/245 |
| 10251 | of 1914 | United Kingdom | 15/245 |

*Primary Examiner*—Paul T. Sewell
*Assistant Examiner*—Ted Kavanaugh
*Attorney, Agent, or Firm*—R. Neil Sudol; Henry D. Coleman

[57] ABSTRACT

A cleaning device comprises a rigid member graspable by a human hand, a resilient member secured to the rigid member, an additional member overlapping the resilient member and fastened to the rigid member, a cleaning strip, and a connector component for releasably attaching the cleaning strip to the additional member so that the cleaning strip is releasably attached to the rigid member and is flexibly braced by the resilient member. The cleaning strip is preferably a strip of nonwoven fabric material such as weatherstripping and the connector component takes the form of a VELCRO type strip.

8 Claims, 4 Drawing Sheets

CLEANING DEVICE

BACKGROUND OF THE INVENTION

This invention relates to a cleaning device. More particularly, this invention relates to a hand held cleaning implement for use in picking up accumulated dirt and dust from walls, ceilings, floors, furniture and other surfaces.

OBJECTS OF THE INVENTION

An object of the present invention is to provide an improved cleaning device.

Another object of the present invention is to provide a cleaning device with a dirt collecting element which is easily replaced once the element becomes laden with collected dirt and dust.

Another, more particular, object of the present invention is to provide such a cleaning device which is simple and inexpensive to manufacture.

An additional, even more particular, object of the present invention is to provide such a cleaning device wherein the dirt collecting element is especially efficient.

SUMMARY OF THE INVENTION

A cleaning device in accordance with the present invention comprises a rigid member graspable by a human hand, a resilient member secured to the rigid member, an additional member overlapping the resilient member and fastened to the rigid member, a cleaning strip, and a connector component for releasably attaching the cleaning strip to the additional member so that the cleaning strip is releasably attached to the rigid member and is flexibly braced against the resilient member.

The cleaning strip is preferably a strip of nonwoven fabric material such as weatherstripping and the connector component takes the form of a VELCRO type strip i.e., a strip of numerous tiny hooks or barbs in a dense array for catching fibers in a coacting fabric strip.

Pursuant to another feature of the present invention, the additional member and the resilient are clamped to the rigid member. Specifically, the rigid member includes a U-shaped profile and the additional member and the resilient member are partially inserted into the U-shaped profile.

The additional member advantageously includes a VELCRO strip i.e., a strip of hooklets or tiny barbs.

The rigid member further includes a handle opening for receiving an elongate handle component.

A cleaning device in accordance with the present invention has a dirt collecting element which is easily replaced once the element becomes laden with collected dirt and dust. The cleaning device is simple and inexpensive to manufacture. In addition, it has been discovered that weatherstripping provides surprisingly efficient electrostatic attraction to dirt and dust particles.

DETAILED DESCRIPTION

Figure 1:
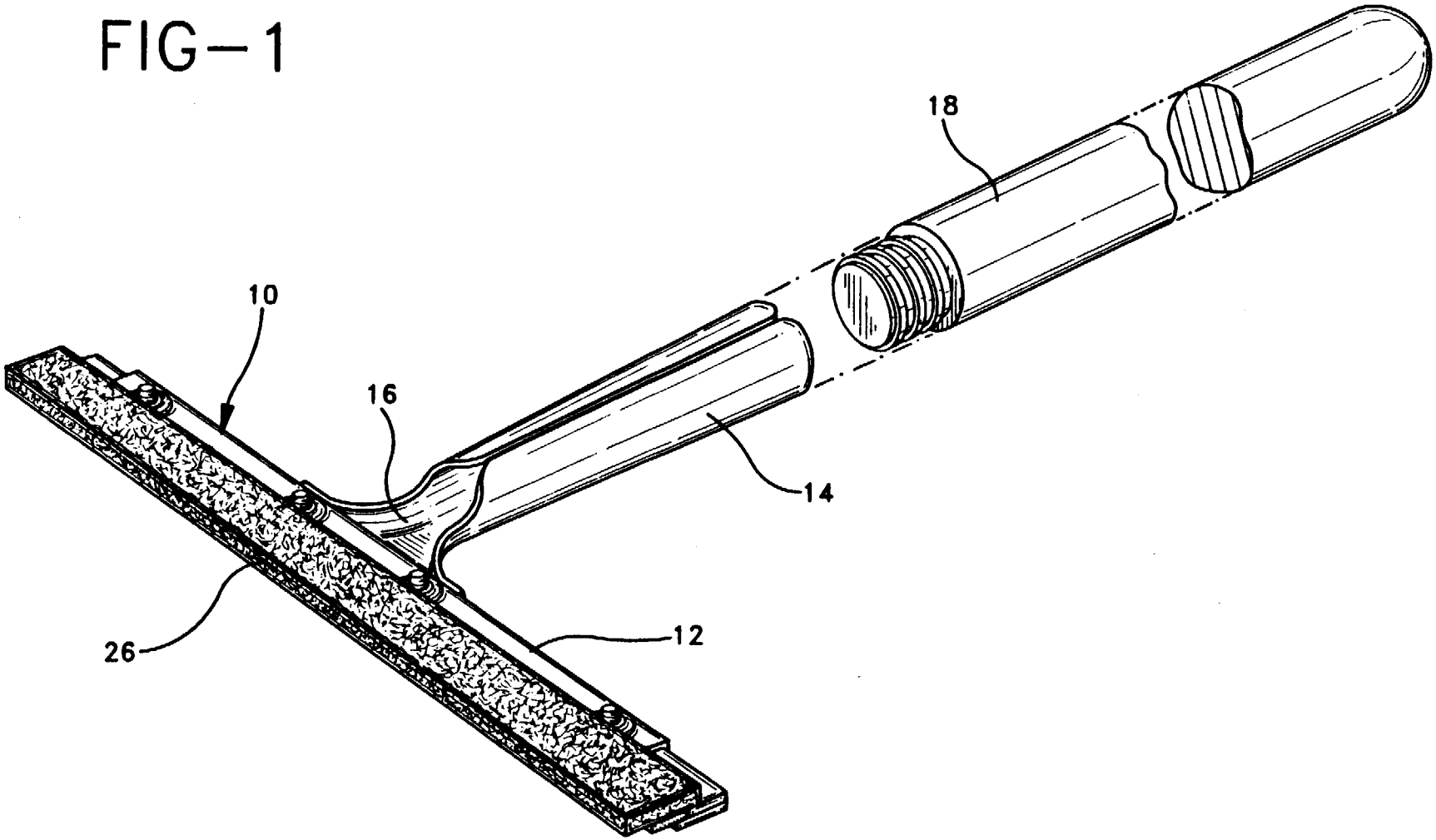
FIG. 1 is a perspective view of a cleaning device in accordance with the present invention.
Figure 2:
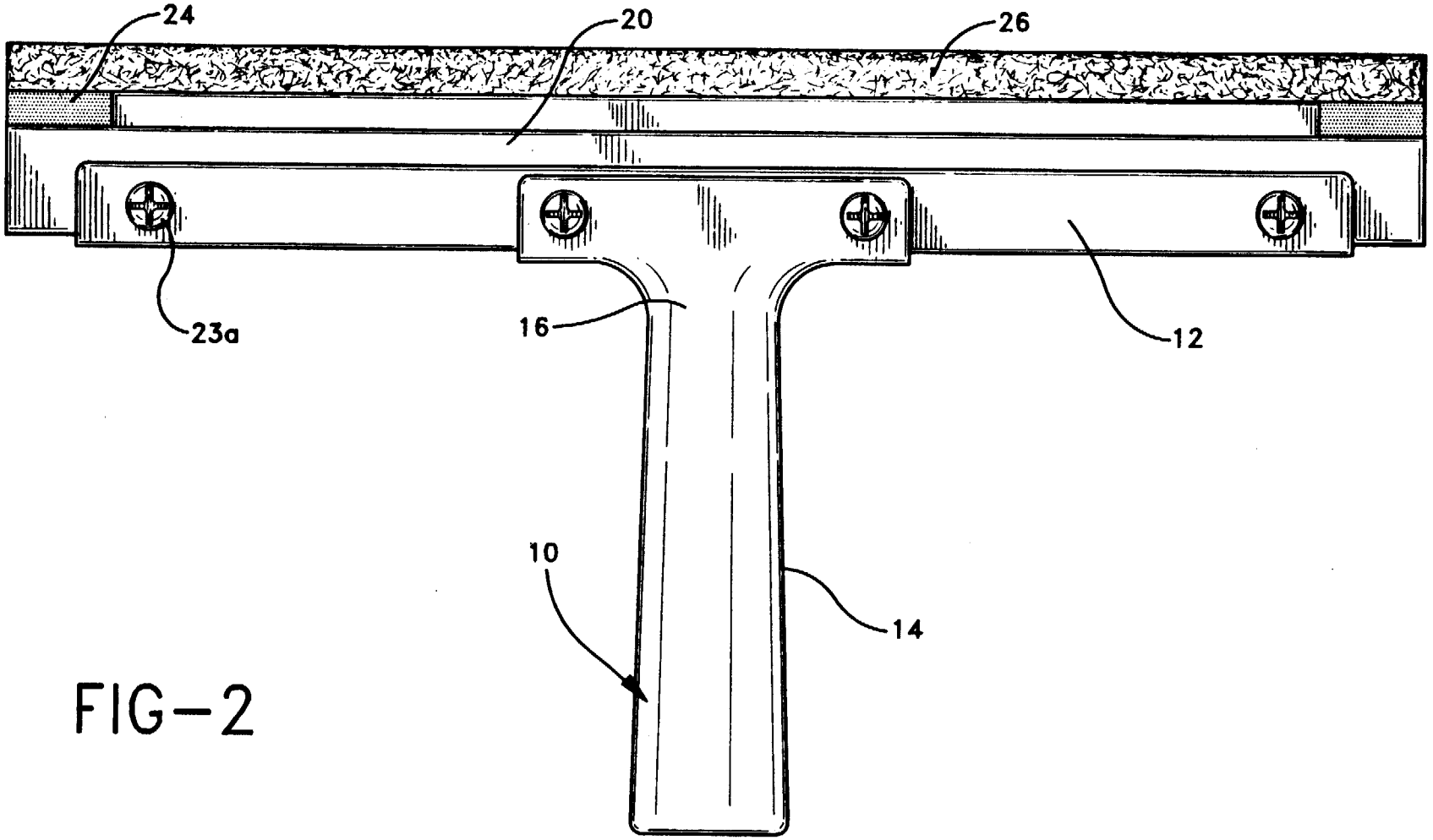
FIG. 2 is a top view of the cleaning device of FIG. 1.
Figure 3:
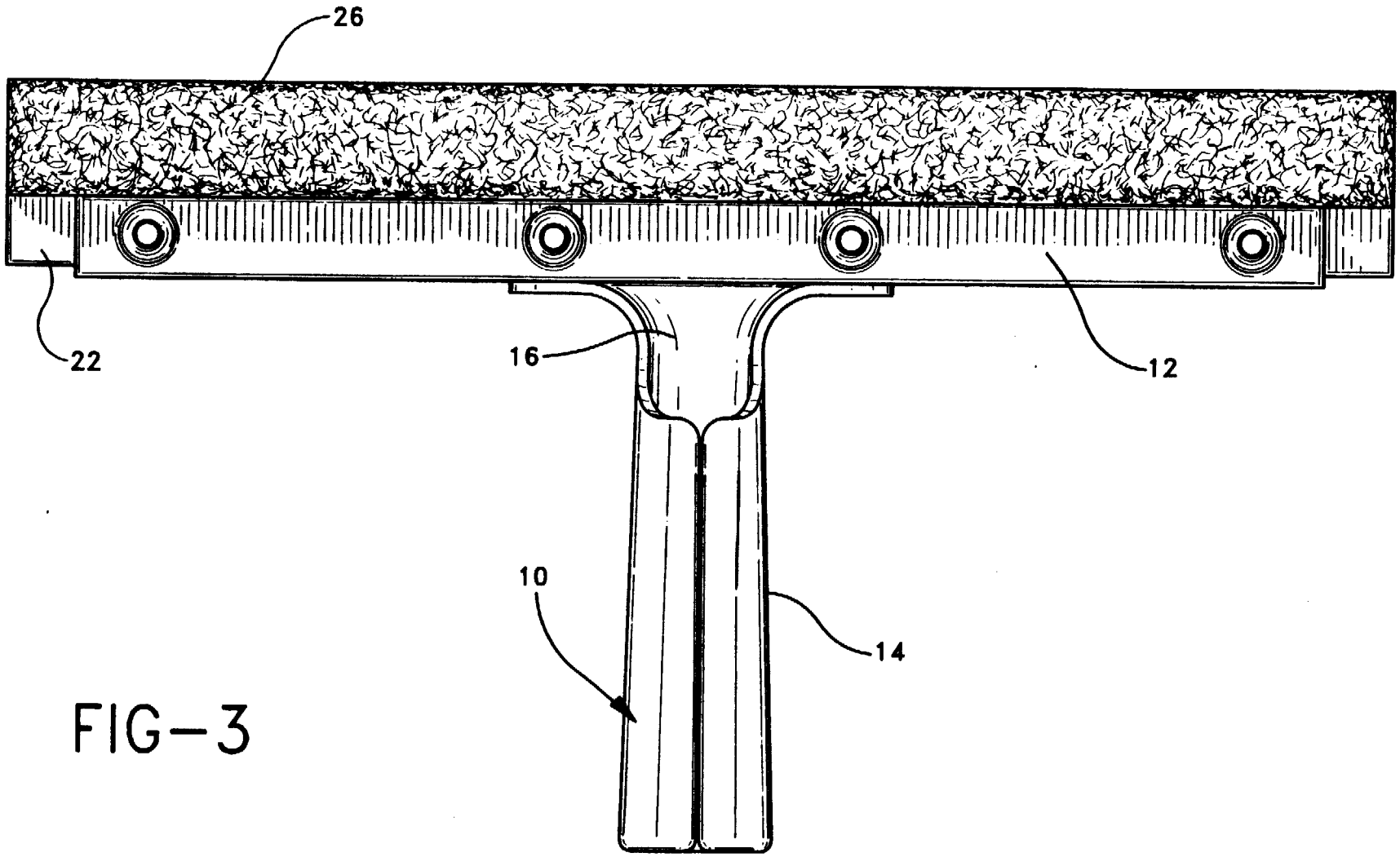
FIG. 3 is a bottom view of the cleaning device of FIGS. 1 and 2.
Figure 4:
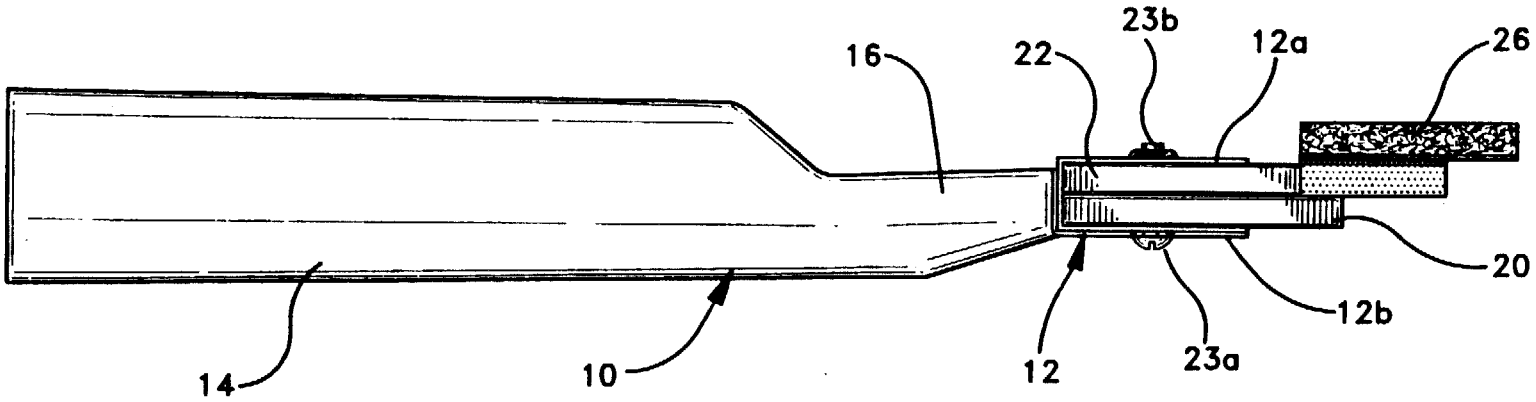
FIG. 4 is a side elevational view of the cleaning device of FIGS. 1–3.
Figure 5:
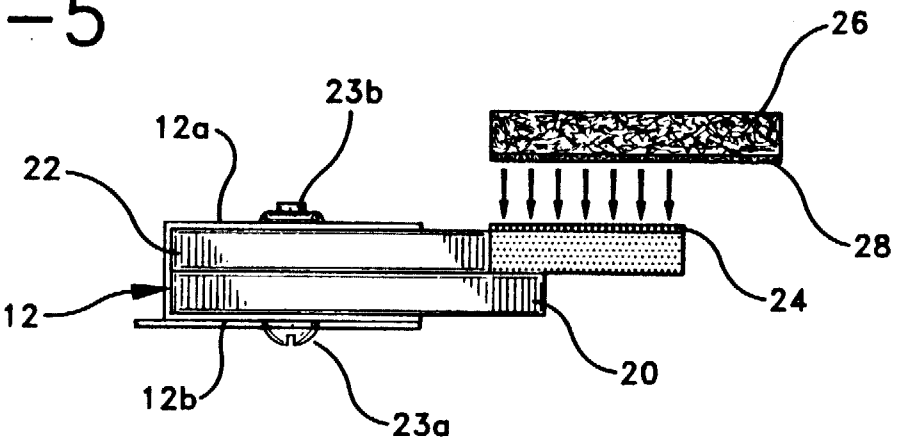
FIG. 5 is a partial side elevational view, on an enlarged scale, of the cleaning device of FIGS. 1–4.

As illustrated in the drawing, a cleaning device comprises a rigid holder or frame 10 including an elongate U-shaped channel member 12 and a substantially cylindrical portion 14 extending at right angles to channel member 12. Cylindrical portion 14 is attached to channel member 12 via a bridge portion 16 and is hollow at an end opposite channel member 12 for purposes of receiving an end of an elongated handle 18.

Sandwiched between legs **12*a* and 12*b* of channel member 12 are an elongate resilient member 20 made of rubber or a synthetic resin material and an elongate attachment member 22. Resilient member 20 and attachment member 22 overlap one another and are partially inserted into channel member 12. Resilient member 20 and attachment member 22 are secured to channel member 12 by a plurality of screws 23*a* and cooperating nuts 23*b*. An outer edge of attachment member 22 is formed as a VELCRO type strip 24, for example, a strip of many plastic hooklets. Attachment or connection member 22 is flexibly braced against resilient member 20**.

An elongate cleaning strip 26 in the form of weatherstripping is provided along one side with a VELCRO type strip 28 of preferably nonwoven fabric material for coacting with attachment member 22 to releasably attach cleaning strip 26 to holder or frame 10.

Cleaning strip 26 is braced against resilient member 20, whereby the resilient member provides a spring type force urging the cleaning strip into contact with a surface to be cleaned. Accordingly, resilient member 20 is disposed on a side of cleaning strip 26 opposite the cleaning surface thereof.

Although the invention has been described in terms of particular embodiments and applications, one of ordinary skill in the art, in light of this teaching, can generate additional embodiments and modifications without departing from the spirit of or exceeding the scope of the claimed invention. For example, screws **23*a* and nuts 23*b* may be replaced by rivets, attachment member 22 may be fastened to resilient member 20, for instance, by an adhesive layer, and VELCRO type nonwoven fabric strip 28 may be omitted, in which case the barbs or hooks of VELCRO strip 24 are engageable in a releasable locking relationship with the individual strands or fibers of weatherstripping cleaning strip 26**. Accordingly, it is to be understood that the drawings and descriptions herein are proferred by way of example to facilitate comprehension of the invention and should not be construed to limit the scope thereof.

What is claimed is:

1. A cleaning device comprising:

a rigid member graspable by a human hand;

a U-shaped profile attached to said rigid member;

a resilient member partially inserted into and secured to said U-shaped profile;

an additional member overlapping said resilient member, said additional member being partially inserted into and fastened to said U-shaped profile;

a cleaning strip; and connection means for releasably attaching said cleaning strip to said additional member on a side of said additional member opposite said resilient member so that said additional member is interposed between said resilient member and said cleaning strip, said connection means including, on one of said additional member and said cleaning strip, a connector member having numerous tiny hooks or barbs in a dense array.

2. The device defined in claim 1 wherein said cleaning strip is a strip of nonwoven fabric material.

3. The device defined in claim 1 wherein said additional member and said resilient member are clamped to said rigid member.

4. The device defined in claim 1 wherein said resilient member is an elongate member made of synthetic resin material.

5. The device defined in claim 1 wherein said resilient member is an elongate member made of rubber material.

6. The device defined in claim 1 wherein said U-shaped profile includes an elongate member having a first length, said resilient member having a second length approximately the same as said first length.

7. The device defined in claim 1 wherein said rigid member further includes means for receiving an elongate handle component.

8. The device defined in claim 1 wherein said cleaning strip is weatherstripping.

* * * * *